US006297484B1

(12) United States Patent
Usui et al.

(10) Patent No.: US 6,297,484 B1
(45) Date of Patent: Oct. 2, 2001

(54) MAGNETIC HEATER

(75) Inventors: Masayoshi Usui; Hiroshi Inoue, both of Numazu; Masato Yamada, Tagata-gun; Kazunori Takikawa, Numazu, all of (JP)

(73) Assignee: Usui Kokusai Sanyo Kaisha LTD (JP)

( * ) Notice: Subject to any disclaimer, the term of this patent is extended or adjusted under 35 U.S.C. 154(b) by 0 days.

(21) Appl. No.: 09/288,902

(22) Filed: Apr. 9, 1999

(30) Foreign Application Priority Data

Apr. 9, 1998 (JP) ..... 10-114218
Jun. 1, 1998 (JP) ..... 10-167723

(51) Int. Cl.[7] ..... H05B 6/10

(52) U.S. Cl. ..... 219/631; 219/628

(58) Field of Search ..... 219/631, 630, 219/672, 628, 629

(56) References Cited

U.S. PATENT DOCUMENTS 4,421,967 * 12/1983 Birgel et al. ..... 219/631
4,635,705 * 1/1987 Kuznetsov ..... 164/466
5,773,798 * 6/1998 Fukumura ..... 219/631
5,914,065 * 6/1999 Alavi ..... 219/631
6,011,245 * 1/2000 Bell ..... 219/631

* cited by examiner

*Primary Examiner*—Tu Ba Hoang
(74) *Attorney, Agent, or Firm*—Anthony J. Casella; Gerald E. Hespos

(57) ABSTRACT

An auxiliary heater is provided for heating a heat transferring fluid to a high temperature efficiently in a short time. The heater includes a permanent magnet provided within a housing and a rotary water jacket made of a conductor positioned to face the permanent magnet leaving a slight gap therebetween. The conductor generates slip heat when the water jacket is rotated in relation to the permanent magnet. The heat transferring fluid within the housing is heated by the slip heat generated in the conductor.

4 Claims, 14 Drawing Sheets

MAGNETIC HEATER

BACKGROUND OF THE INVENTION

1. Field of the Invention

The present invention relates to a magnetic heater for use as auxiliary heating means of heat transferring fluid such as engine cooling water used for improving the starting performance of various vehicular engines of cars in particular whose power source is a diesel engine or a gasoline engine and for heating a cabin of various vehicles including electric cars and ships when the weather is cold or is extremely cold and for use in a generator driven by an engine, a welding machine, a compressor, a unit for preheating or quickly heating engine cooling water of construction machines (to shorten warming up time), a unit for forced-feeding hot water while heating, a heater of an air conditioner and a dryer such as a hair dryer.

2. Description of the Related Art

There has been known a viscous type heater as a vehicular auxiliary heating source of a car and the like used for heating engine cooling water in starting the car in a cold district (see JP-A-2-246823, JP-A-4-11716U, JP-A-9-254637, JP-A-966729, JP-A-9-323530 and others).

The viscous type heater is a system which causes viscous fluid such as silicon oil to generate heat by shearing and utilizes the heat as a heating source by heat-exchanging it with circulating water circulating within a water jacket. It comprises an exothermic chamber within a housing, the water jacket formed on the outside of the exothermic chamber, a driving shaft rotably supported by the housing via a bearing and a rotor which is turnable within the exothermic chamber and which is fixed to the driving shaft. The viscous fluid such as the silicon oil is filled in a gap between the wall face of the exothermic chamber and the rotor. The circulating water circulates within the water jacket so that it is taken in from a water inlet port and is sent out to an external heating circuit from a water outlet port.

When the driving shaft is driven by an engine, the rotor rotates within the exothermic chamber in the viscous type heater incorporated in a heating system of a vehicle. Then, the viscous fluid generates heat by being sheared at the gap between the wall face of the exothermic chamber and the outer face of the rotor. This heat is heat-exchanged with the circulating water within the water jacket and the heated circulating water is utilized to heat the vehicle such as the engine cooling water.

However, although the viscous type heater described above has had advantages that its simple structure allows the miniaturization and the low cost to be realized, its non-wearing and non-contact mechanism allows high reliability and safety to be maintained and it uses no wasteful energy because its operation stops automatically by temperature control when the water temperature rises and the auxiliary heater is not required, it has had problems that the temperature of the silicon oil used as the viscous fluid cannot be so high because the heat resistance of the silicon oil is around 240° C., it takes time until when the silicon oil generates high temperature heat after being agitated at the start and the heating effect cannot be obtained quickly when the engine is cold because its heating value per unit time tends to decrease gradually because the viscosity drops and the shearing resistance drops when the temperature of the silicon oil increases. Therefore, such viscous type heater has not been fully effective in case of a vehicle specific for a cold district and carrying a diesel engine in particular and an auxiliary heater capable of heating the heat transferring fluid efficiently in a shorter time has been requested.

The present invention has been devised in view of such problems of the viscous type heater and its object is to provide a magnetic heater which is capable of heating the heat transferring fluid to high temperature in a short time and is excels in the heat resistance as compared to the viscous type heater.

SUMMARY OF THE INVENTION

An inventive magnetic heater is of the type in which a slip heat generated in the conductor side by shearing a magnetic path created between a magnet and a conductor is heat-exchanged to heat transferring fluid. Its gist is that the magnet and the conductor are disposed so as to face each other leaving a slight gap and the heat transferring fluid is heated by the slip heat which is generated in the conductor by relatively rotating the magnet and the conductor.

Its first aspect is characterized in that a magnet and a conductor are disposed facing each other while leaving a slight gap and heat transferring fluid is heated by slip heat which is generated in the conductor by relatively rotating the magnet and the conductor.

A second aspect thereof is characterized in that in the magnetic heater of the type in which a magnet and a conductor are disposed so as to face to each other leaving a slight gap and heat transferring fluid is heated by slip heat which is generated in the conductor by relatively rotating the magnet and the conductor, the magnetic heater comprises the permanent magnet fixed to a housing supported to a driving shaft via a bearing; and a disc-like conductor facing to the permanent magnet while leaving a slight gap provided rotably by a driving shaft within a housing; and the heat transferring fluid introduced to the inside of the housing is heated by the slip heat generated in the conductor as the disc-like conductor rotates.

A third aspect is characterized in that in the magnetic heater of the type in which a magnet and a conductor are disposed so as to face to each other leaving a slight gap and heat transferring fluid is heated by slip heat which is generated in the conductor by relatively rotating the magnet and the conductor, the magnetic heater comprises a permanent magnet and a heat transferring fluid jacket having the conductor disposed so as to face to the permanent magnet leaving a slight gap rotably provided by a driving shaft within a housing supported by the driving shaft via a bearing; and the heat transferring fluid introduced to the inside of the housing is heated by the slip heat generated in the conductor as the heat transferring fluid jacket rotates.

A fourth aspect is characterized in that in the magnetic heater of the type in which a magnet and a conductor are disposed so as to face each other leaving a slight gap and heat transferring fluid is heated by slip heat which is generated in the conductor by relatively rotating the magnet and the conductor, the magnetic heater comprises a pair of right and left permanent magnets disposed so as to face leaving a gap; and a heat transferring fluid jacket having a pair of right and left conductors interposed between the permanent magnets and disposed so as to face to the respective permanent magnets leaving a slight gap and are provided with heat transferring fluid passages therein are provided rotably by a driving shaft within the housing supported by the driving shaft via a bearing; and the heat transferring fluid introduced to the inside of the housing is heated by the slip heat generated in the conductors as the heat transferring fluid jacket rotates.

A fifth aspect is characterized in that a permanent magnet rotor disposed so as to face to a conductor while leaving a slight gap is fixed around a driving shaft rotably supported via a bearing in a cylindrical housing provided with a heat transferring fluid jacket for circulating heat transferring fluid at the outer periphery thereof and the conductor is fixed on the inner peripheral surface thereof and the heat transferring fluid within the heat transferring fluid jacket is heated by slip heat generated in the conductor as the permanent magnet rotor rotates.

A sixth aspect is characterized in that in the magnetic heater of the type in which a magnet and a conductor are disposed so as to face each other leaving a slight gap and heat transferring fluid is heated by slip heat which is generated in the conductor by relatively rotating the magnet and the conductor, the magnetic heater comprises the conductor non-rotably supported to a driving shaft as a heat transferring fluid jacket; and magnet rotors rotably provided by the driving shaft and having magnets disposed so as to face to the fluid jacket leaving a slight gap on the both sides of the heat transferring fluid jacket; and the heat transferring fluid within the heat transferring fluid jacket is heated by slip heat generated in the non-rotable heat transferring fluid jacket disposed between the magnet rotors as the right and left magnet rotors rotate.

A seventh aspect is characterized in that in the magnetic heater of the type in which a magnet and a conductor are disposed so as to face each other leaving a slight gap and heat transferring fluid is heated by slip heat which is generated in the conductor by relatively rotating the magnet and the conductor, the magnetic heater comprises a heat transferring fluid jacket made of resin which is partially made of the conductor and is non-rotably supported by a driving shaft via a bearing; permanent magnet rotors rotably provided by the driving shaft and having magnets disposed so as to face to the conductor of the heat transferring fluid jacket leaving a slight gap; and a back plate on the inner wall of the conductor on the side facing to the permanent magnet within the heat transferring fluid jacket; and the heat transferring fluid within the heat transferring fluid jacket is heated by slip heat generated in the heat transferring fluid jacket as the permanent magnet rotors rotate.

An eighth aspect is characterized in that in the magnetic heater of the type in which a magnet and a conductor are disposed so as to face each other leaving a slight gap and heat transferring fluid is heated by slip heat which is generated in the conductor by relatively rotating the magnet and the conductor, the conductors are disposed so as to face each other on the both sides of the magnets.

An ninth aspect is characterized in that in the magnetic heater of the type in which a magnet and a conductor are disposed so as to face each other leaving a slight gap and heat transferring fluid is heated by slip heat which is generated in the conductor by relatively rotating the magnet and the conductor, the magnetic heater comprises a permanent magnet rotably provided by the driving shaft and a pair of right and left conductors disposed so as to face to the permanent magnet leaving a slight gap on the both sides of the permanent magnet within a housing supported to the driving shaft via a bearing and a shaft sealer; and the heat transferring fluid introduced to the inside of the housing is heated by slip heat generated in the conductor as the permanent magnet rotates; and one or a plurality of sets of the combination of the permanent magnet and the pair of right and left conductors are provided.

A tenth aspect is characterized in that in the magnetic heater of the type in which a magnet and a conductor are disposed so as to face each other leaving a slight gap and heat transferring fluid is heated by slip heat which is generated in the conductor by relatively rotating the magnet and the conductor, the magnetic heater comprises a plurality of permanent magnets fixed within a housing supported by a driving shaft via bearing and a shaft sealer at intervals; and a pair of right and left conductors facing to each permanent magnet leaving a slight gap on the both sides of each of the permanent magnets and rotably fixed to the driving shaft; and the heat transferring fluid introduced to the inside of the housing is heated by slip heat generated in the conductor as each of the conductor rotates.

An eleventh aspect is characterized in that in the magnetic heater of the type in which a magnet and a conductor are disposed so as to face each other leaving a slight gap and heat transferring fluid is heated by slip heat which is generated in the conductor by relatively rotating the magnet and the conductor, the magnetic heater comprises a permanent magnet rotably provided by the driving shaft and a pair of right and left conductors disposed so as to face to the permanent magnet leaving a slight gap on the both sides of the permanent magnet within a housing supported to the driving shaft via a bearing and a shaft sealer; and the heat transferring fluid introduced to the inside of the housing being heated by slip heat generated in the conductor as the permanent magnet rotates; and one or a plurality of sets of the combination of the permanent magnet and the pair of right and left conductors being provided.

A twelfth aspect is characterized in that in the magnetic heater of the type in which a magnet and a conductor are disposed so as to face each other leaving a slight gap and heat transferring fluid is heated by slip heat which is generated in the conductor by relatively rotating the magnet and the conductor, a planetary gear mechanism is used as the means for rotating them relatively.

A thirteenth aspect is characterized in that in the magnetic heater of the type in which a magnet and a conductor are disposed so as to face each other leaving a slight gap and heat transferring fluid is heated by slip heat which is generated in the conductor by relatively rotating the magnet and the conductor, the magnetic heater comprises a rotary member made of a conductor, fixed to a driving shaft and stored in a casing; and a magnet rotor having a permanent magnet disposed so as to face to the conductor rotary member while leaving a slight gap; and heat transferring fluid within the casing being heated by slip heat generated in the rotary member made of the conductor when the magnetic rotor and the conductor rotary member rotate relatively. The magnetic heater is characterized in that the magnetic rotor is supported to the driving shaft of the conductor rotary member so that they can rotate in the opposite direction from each other via a planetary gear mechanism, that the planetary gear mechanism comprises a sun gear secured to the driving shaft, a pinion gear axially supported to a carrier supported to the driving shaft via a bearing and a ring gear secured the side of the magnet rotor and that the heat transferring fluid within the casing is heated by rotating the magnetic rotor and the conductor rotary member in the opposite direction to increase the rotational speed of the driving shaft by rotating the carrier in the opposite direction from the driving shaft.

In the aspects described above, thermal ferrite may be employed instead of the permanent magnet or an eddy-current member or a hysteresis member may be employed for the conductor.

That is, the invention is composed of two members of the magnet such as a permanent magnet, thermal ferrite and an electromagnet and a conductor (exothermic body) such as a material whose electrical hysteresis is large (hereinafter referred to as a "hysteresis member") or an eddy-current member. The invention utilizes slip heat generated on the conductor side by shearing the mnagnetic path by relatively rotating the magnet and the conductor which face each other leaving a slight gap. It has a feature that it can generate heat up to temperature of 200 to 600° C. in several to several tens seconds by using the eddy-current member or the hysteresis member for the exothermic body.

It is noted that the "slip heat" described above means that eddy current is generated within the conductor and heat is generated by electrical resistance within the conductor having the eddy current when the conductor is moved (rotated) in the direction of cutting the magnetic field generated by the magnet.

Although the conductor generates heat primarily by the relative rotation between the magnet and the conductor, magnetic force of the magnet is weakened slightly by radiant heat from the conductor and the driving torque is decreased more or less, it is no match to the degree of the viscous type heater and it can keep a high heating value.

As the method for shearing the magnetic path by relatively rotating the magnet and the conductor disposed so as to face each other leaving a slight gap, there are methods of rotating either one of the magnet side and the conductor side, of rotating the magnet side and the conductor side in the direction opposite from each other of rotating in the same direction while changing the revolving speed of the magnet side and the conductor side. It is noted that the gap is normally 0.3 to 1.0 mm, though it is not specifically limited.

As the method for exchanging heat in the invention, a method of contacting the heat transferring fluid directly or indirectly to the conductor, i.e., the exothermic body, may be used. A method of exposing the face of the conductor on the opposite side from the magnet is exposed within the heat transferring fluid jacket may be used as the method for exchanging heat by directly contacting the heat transferring fluid to the conductor and a method of exchanging heat via the heat transferring fluid jacket may be used as the method for exchanging heat by indirectly contacting the heat transferring fluid to the conductor.

Further, as a rotary driving source of the invention, a method of driving the driving shaft by the engine via the pulley, or a dedicated motor, wind power and water power may be used beside the engine.

Still more, the electromagnetic clutch, the thermal ferrite, an electromagnetic brake, an electromagnetic coil and others may be used as ON-OFF control means of the magnetic heater. It is noted that soft ferrite is pasted on the permanent magnet in general in the thermal ferrite. Because it is a magnet having a characteristic that a magnetic path passes through the soft ferrite when heat is generated to a certain temperature or more and a magnetic path is created on the outside of the soft ferrite when the temperature drops below the certain temperature in contrary, it becomes possible to control ON-OFF automatically and an ON-OFF control system becomes unnecessary by using the thermal ferrite for the magnet. Power is fed via a slip ring or the like when an electromagnet is rotated.

The specific nature of the invention, as well as other objects, uses and advantages thereof, will clearly appear from the following description and from the accompanying drawings.

DESCRIPTION OF THE PREFERRED EMBODIMENTS

Figure 1:
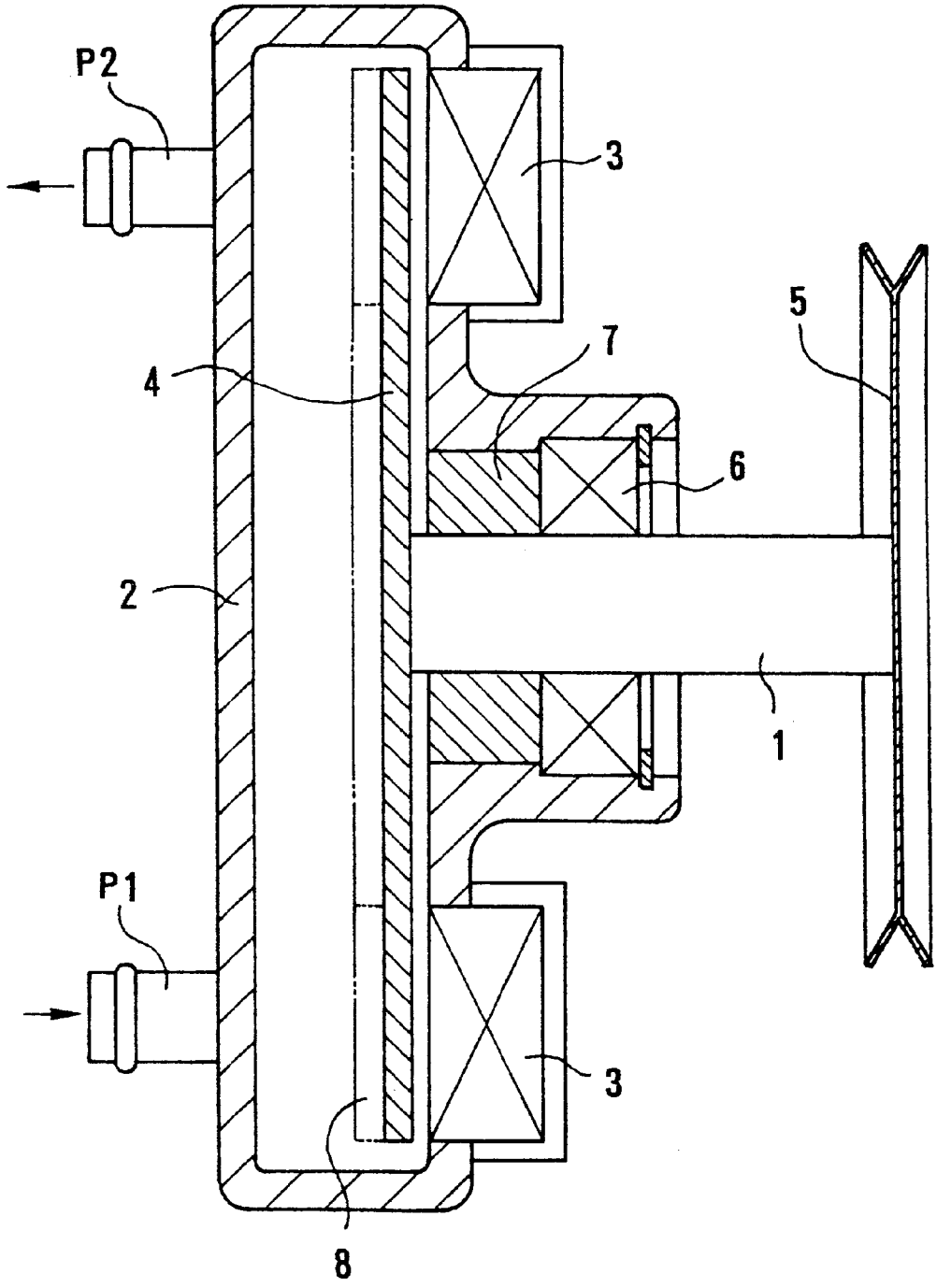
FIG. 1 is a longitudinal section view showing an embodiment of a magnetic heater corresponding to claim 2 of the invention.
Figure 2:
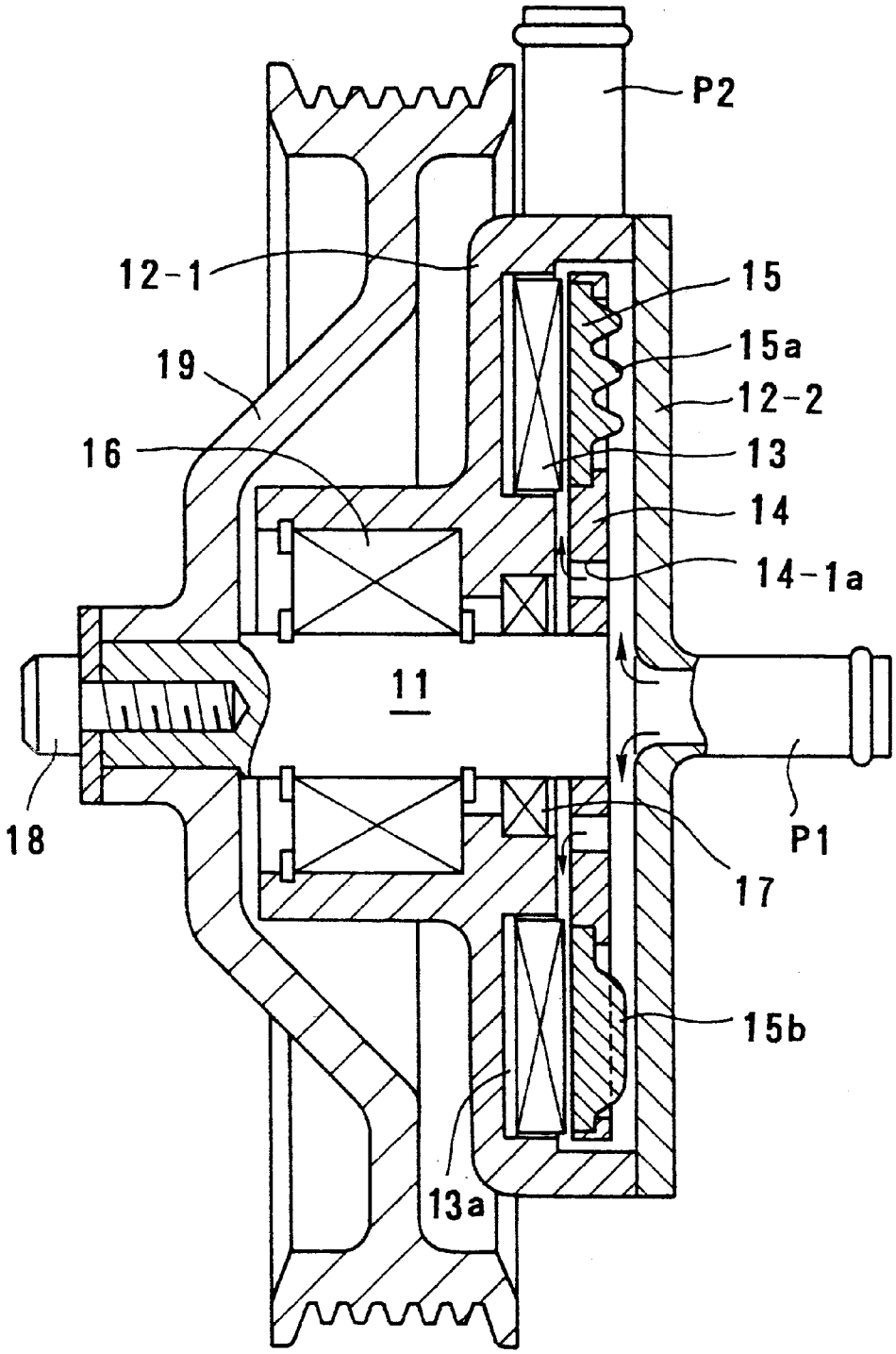
FIG. 2 is a longitudinal section view showing an embodiment of a magnetic heater corresponding to claim 3 of the invention.
Figure 3:
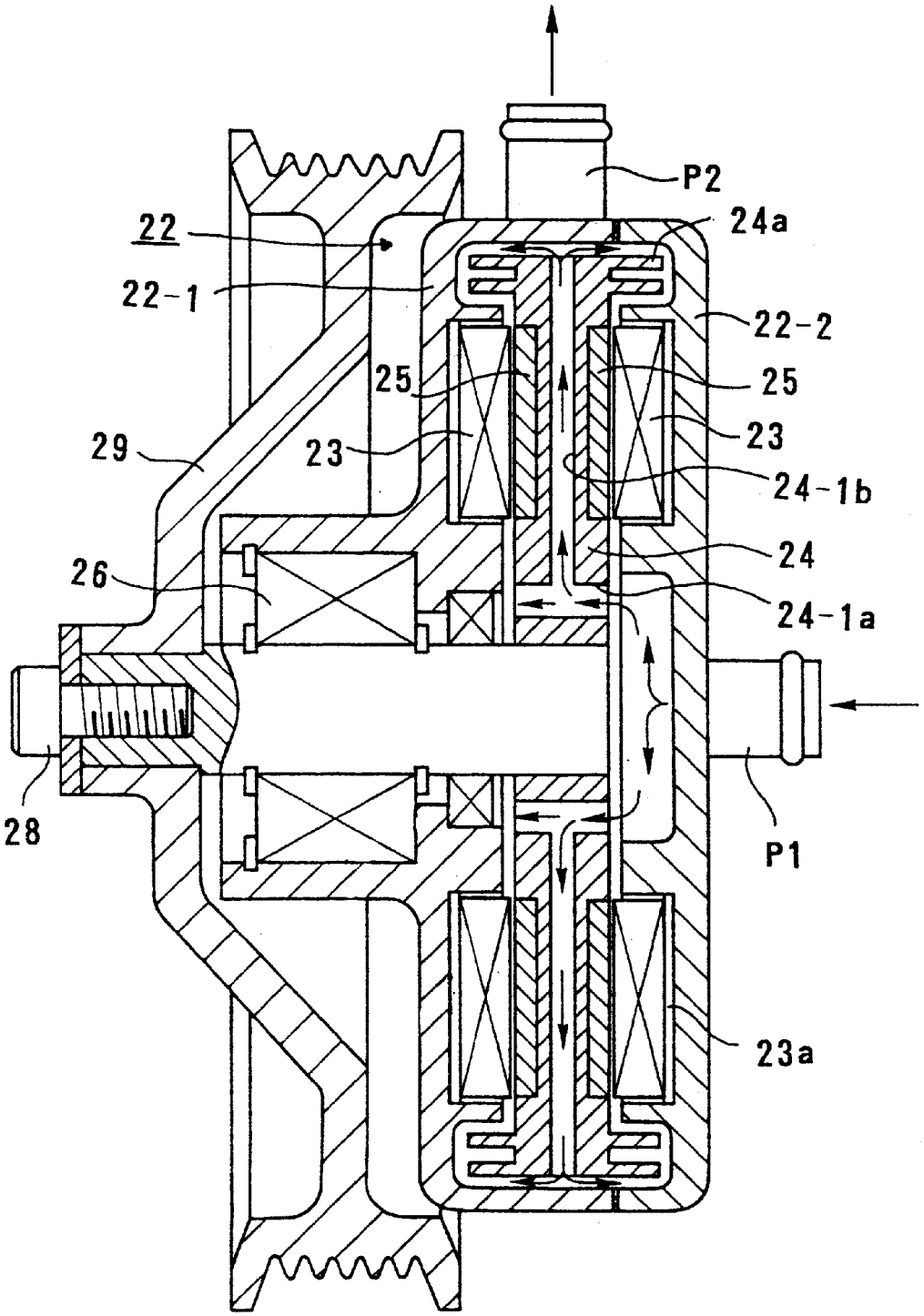
FIG. 3 is a longitudinal section view showing an embodiment of a magnetic heater corresponding to claim 4 of the same.
Figure 4:
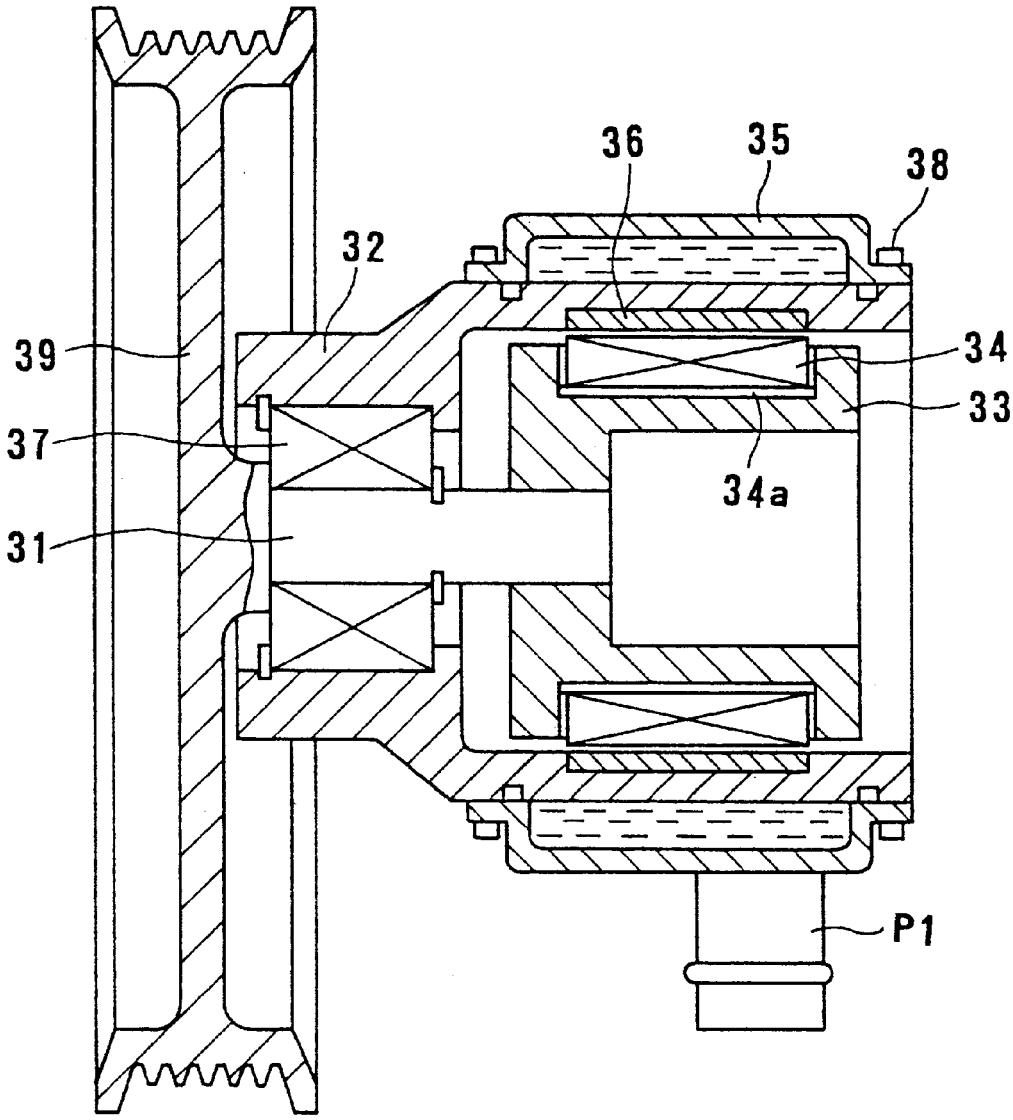
FIG. 4 is a longitudinal section view showing an embodiment of a magnetic heater corresponding to claim 5 of the same.
Figure 5:
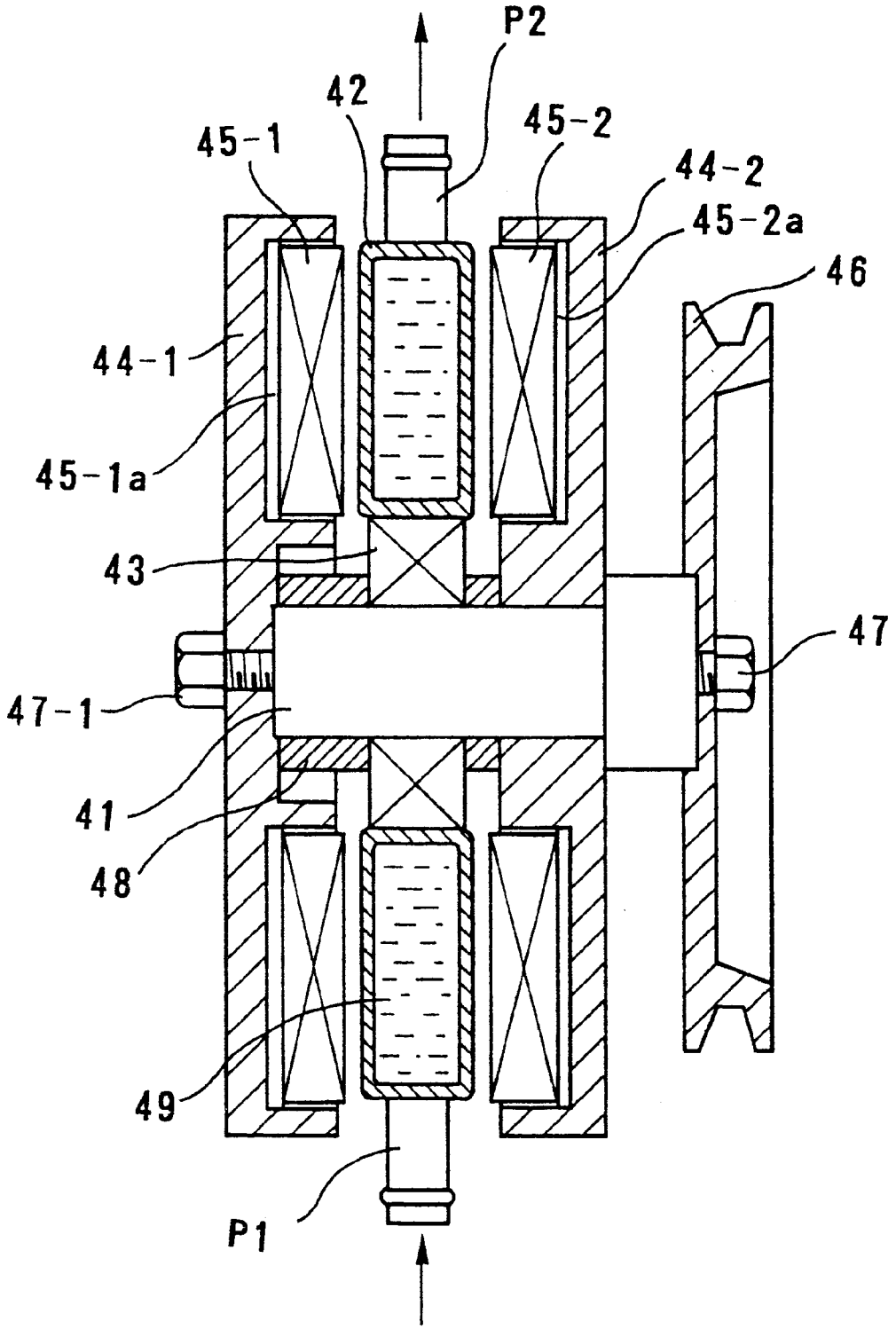
FIG. 5 is a longitudinal section view showing an embodiment of a magnetic heater corresponding to claim 6 of the same.
Figure 6:
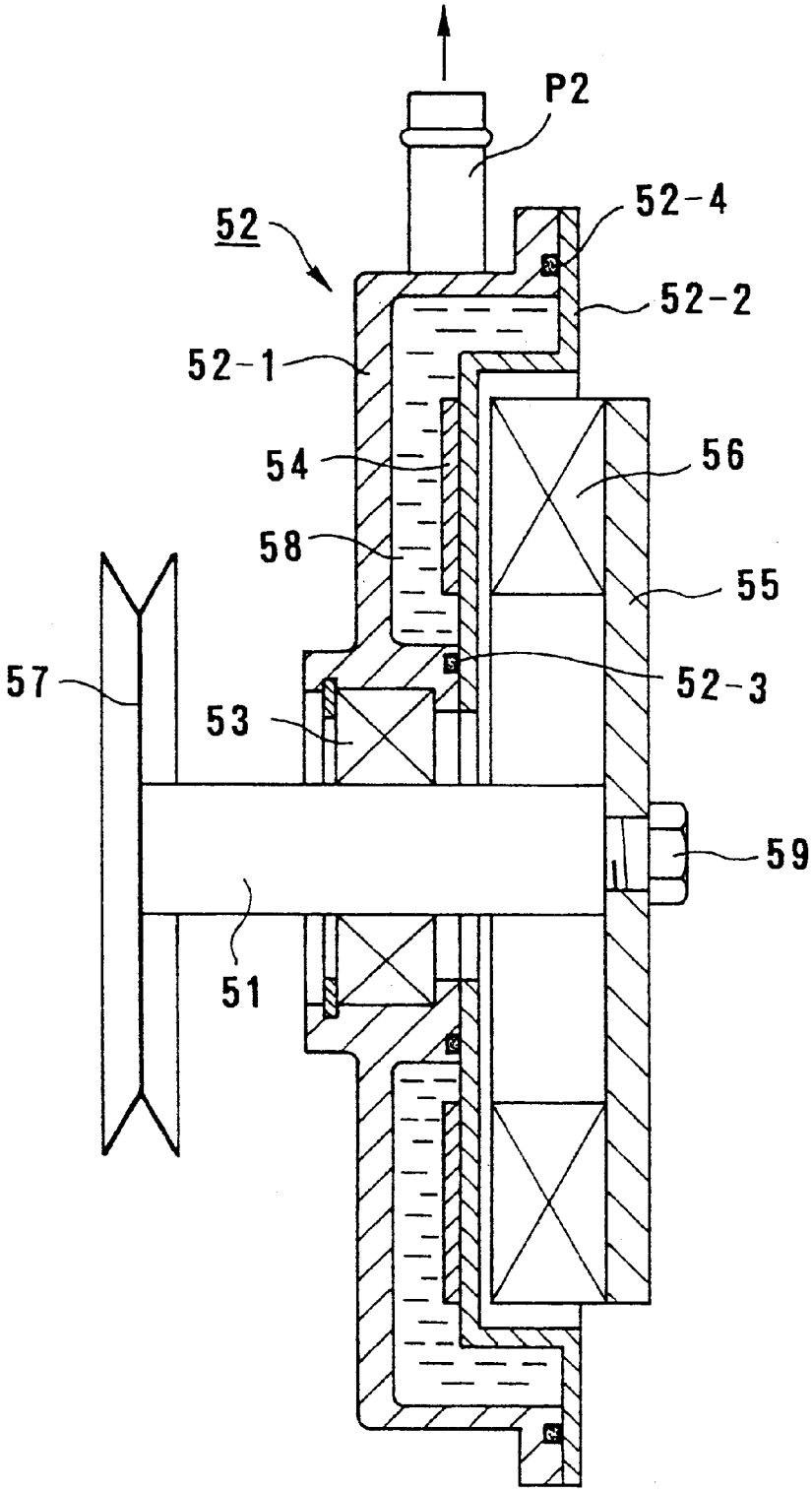
FIG. 6 is a longitudinal section view showing an embodiment of a magnetic heater corresponding to claim 7 of the same.
Figure 7:
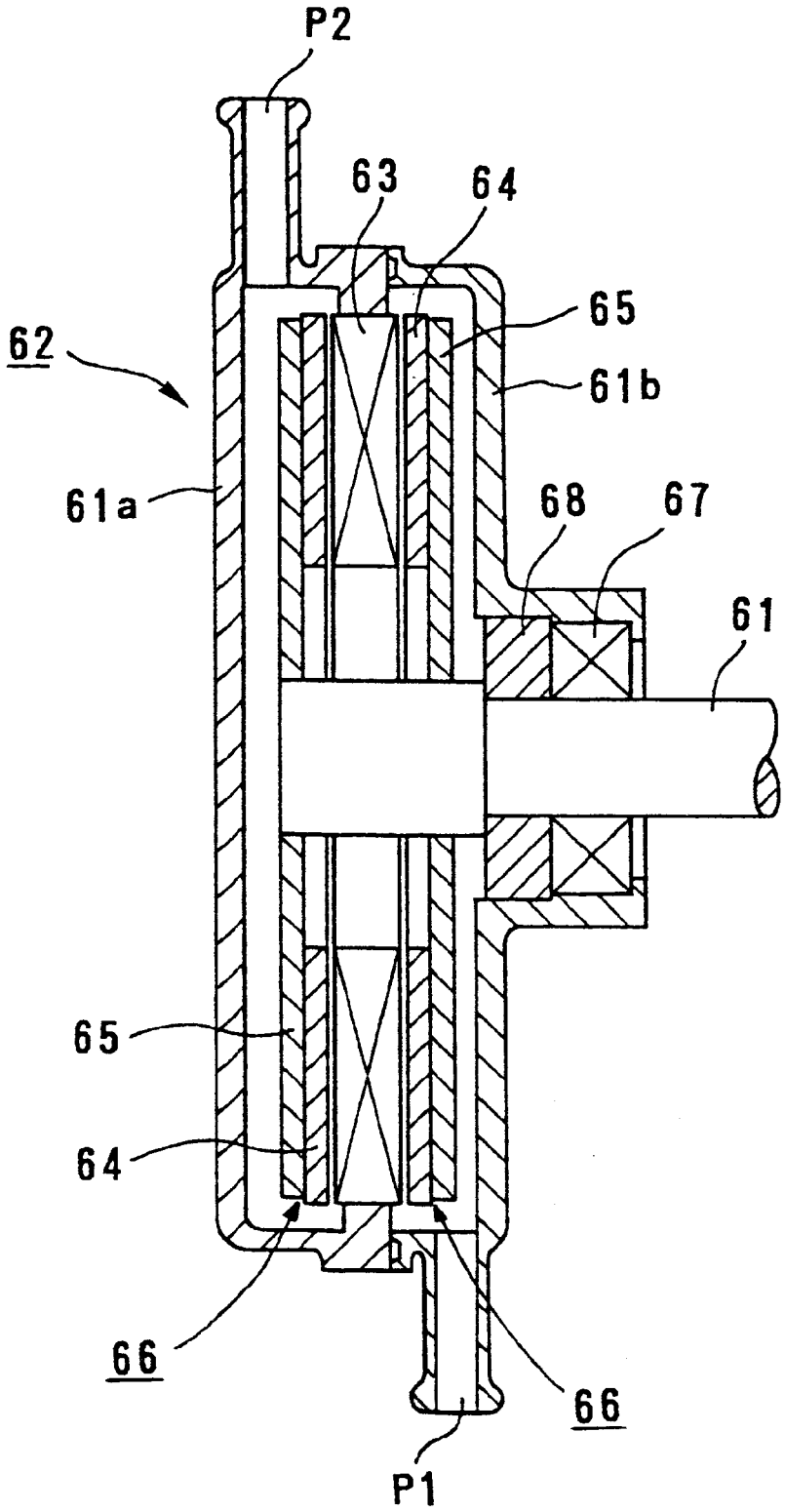
FIG. 7 is a longitudinal section view showing an embodiment of a magnetic heater corresponding to claim 9 of the same.
Figure 8:
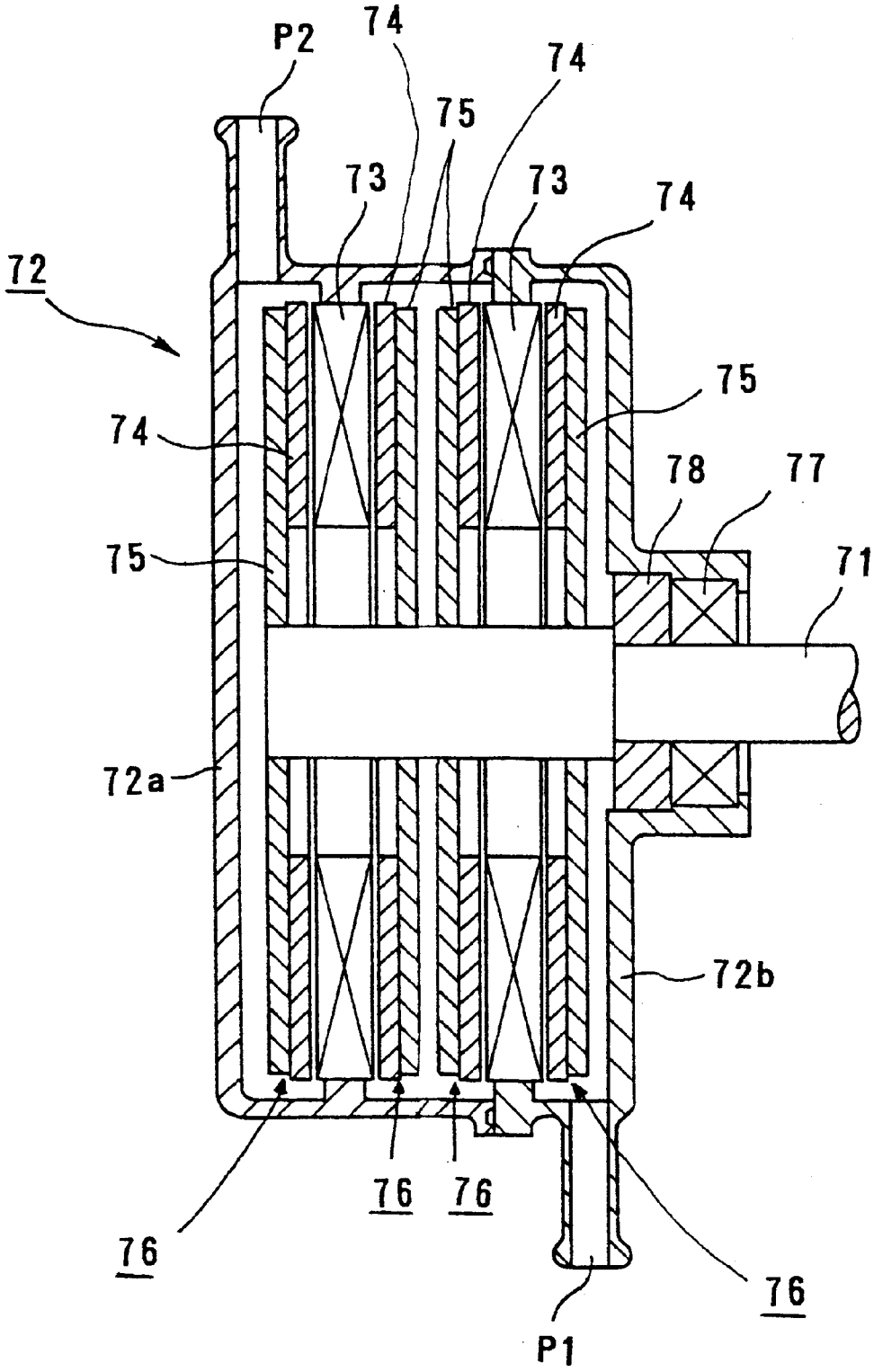
FIG. 8 is a longitudinal section view showing an embodiment of a magnetic heater corresponding to claim 10 of the same.
Figure 9:
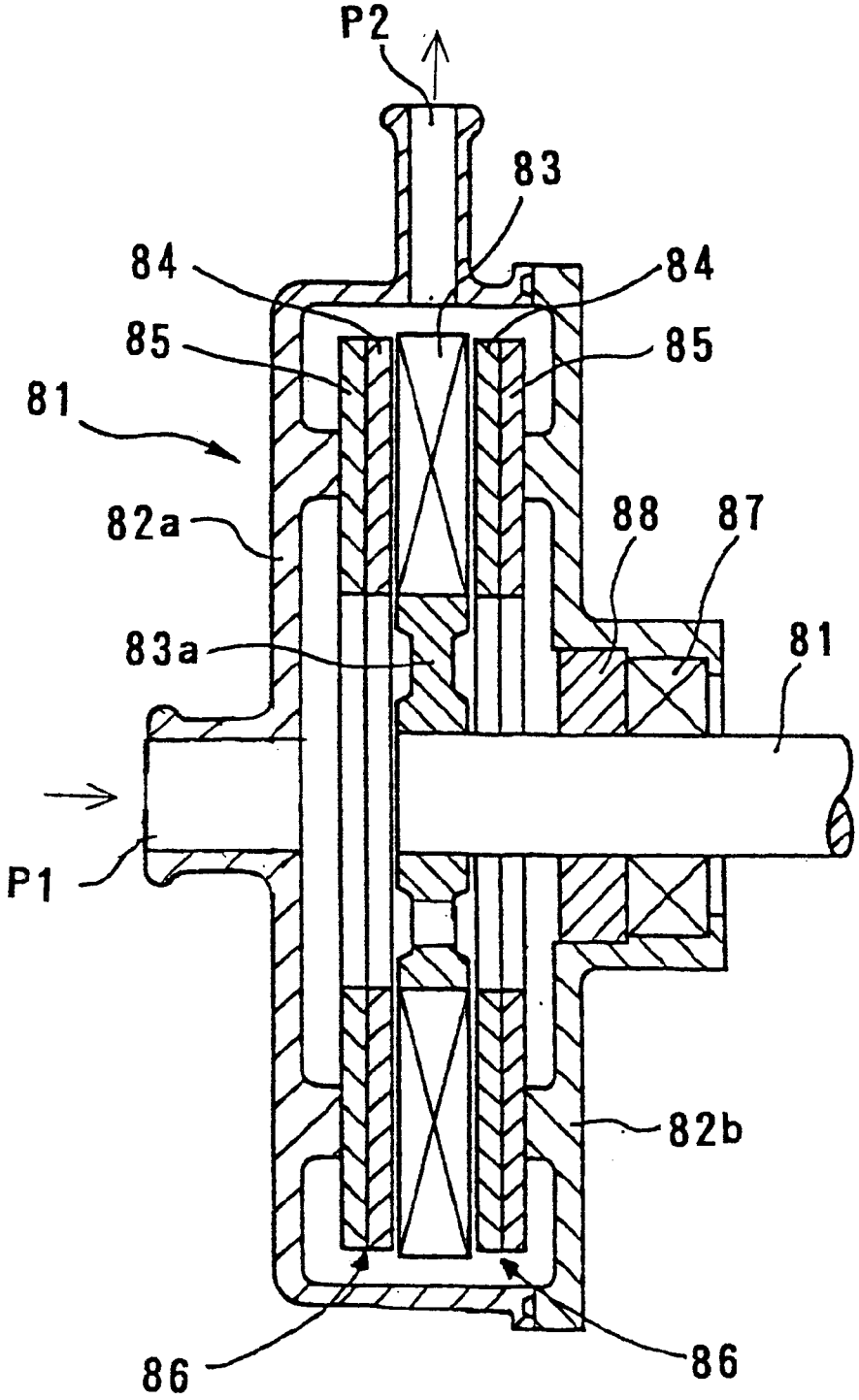
FIG. 9 is a longitudinal section view showing an embodiment of a magnetic heater corresponding to claim 11 of the same.
Figure 10:
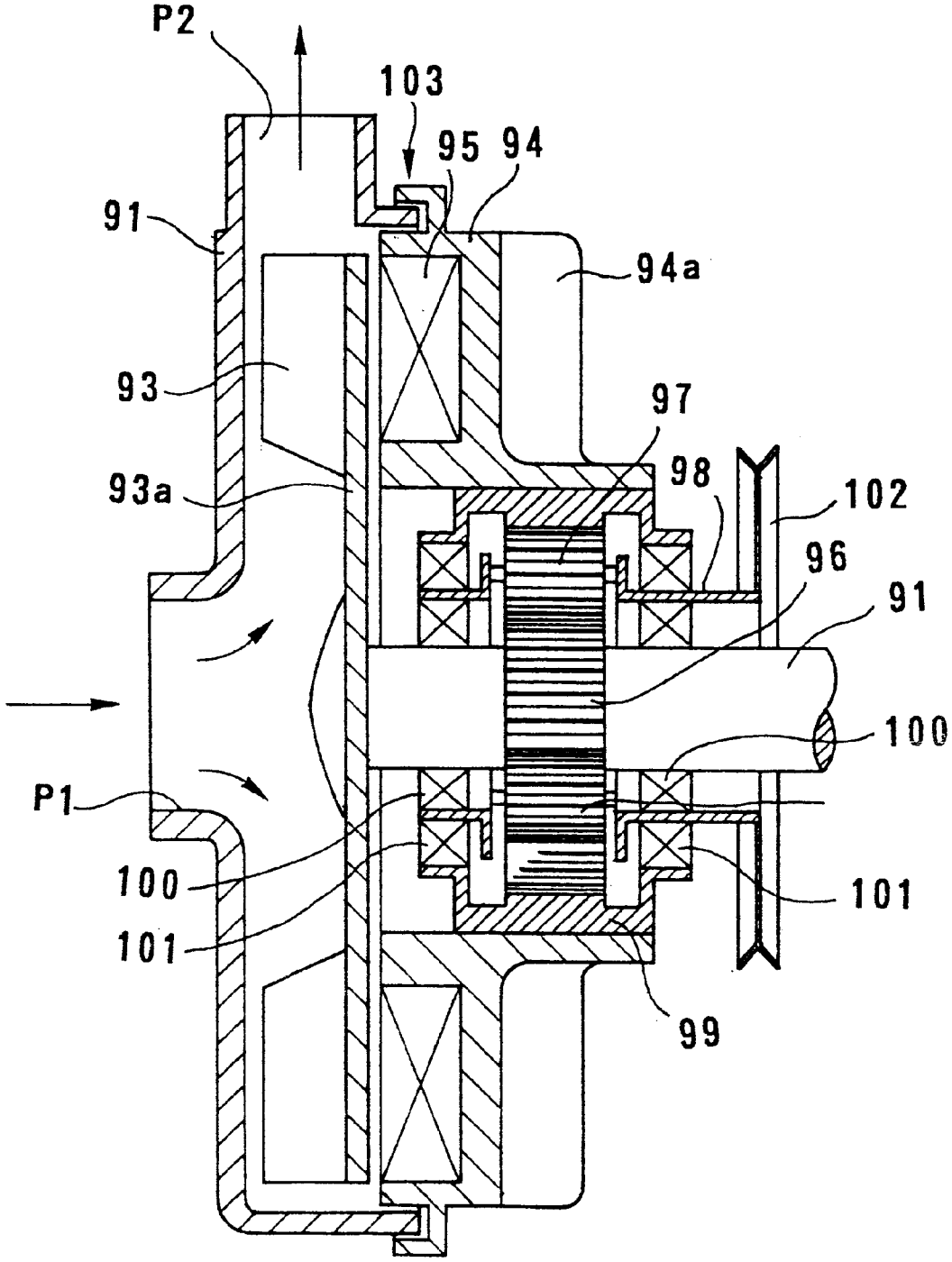
FIG. 10 is a longitudinal section view showing an embodiment of a magnetic heater corresponding to claim 13 of the same.
Figure 11:
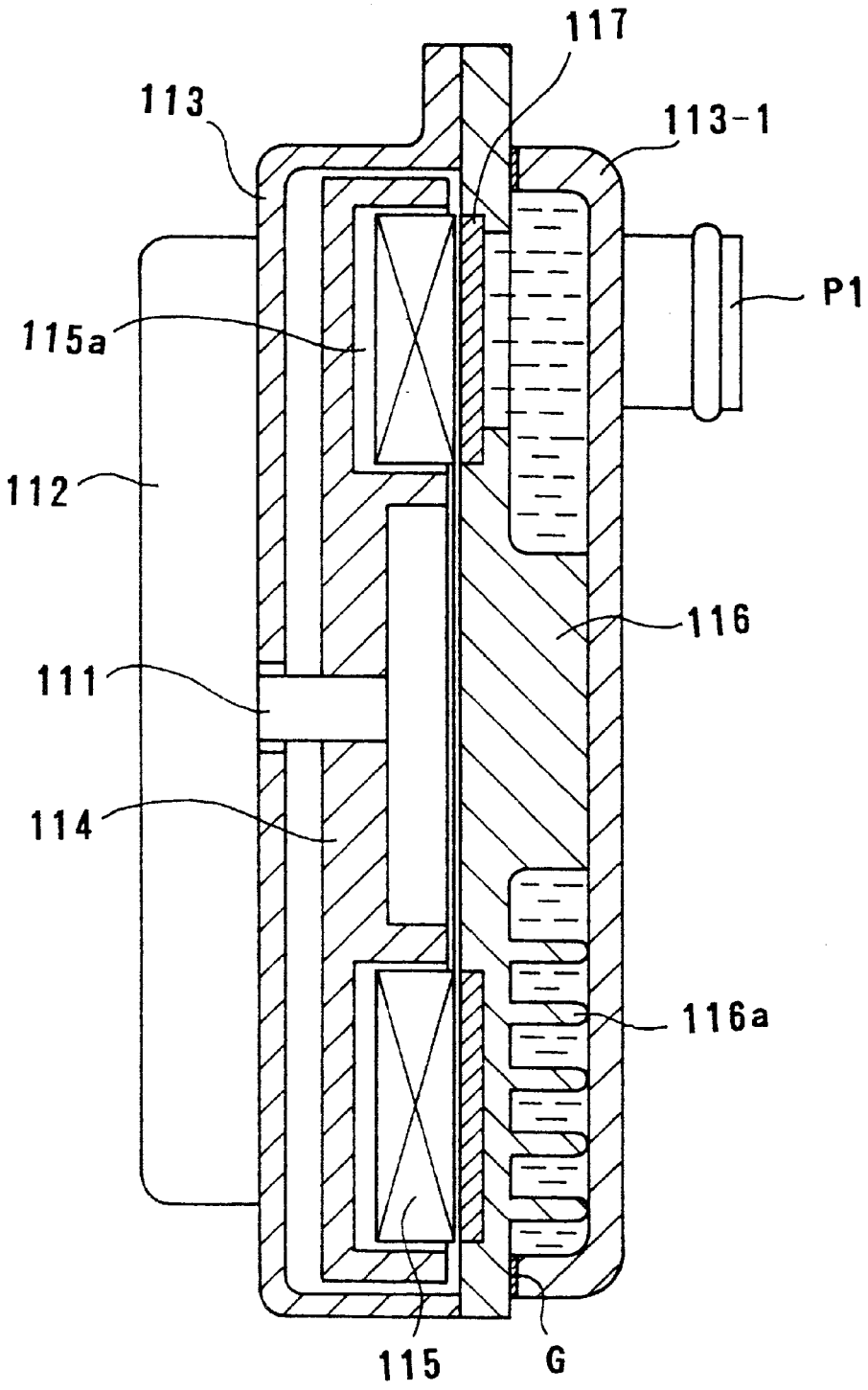
FIG. 11 is a longitudinal section view showing an embodiment of ON-OFF control means by means of a motor of the magnetic heater of the same.
Figure 12:
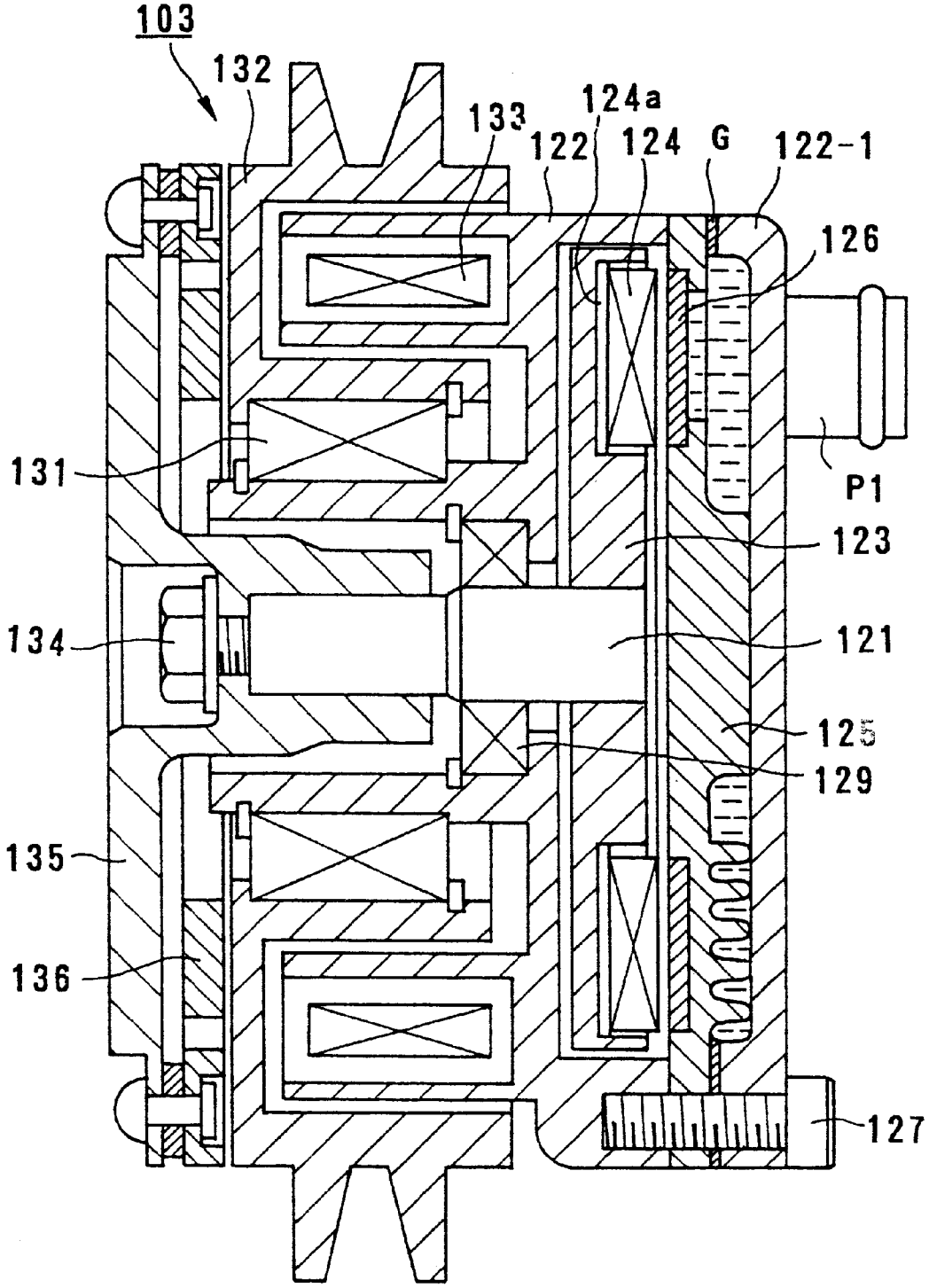
FIG. 12 is a longitudinal section view showing an embodiment of ON-OFF control means by means of an electromagnetic clutch of the magnetic heater of the same.
Figure 13:
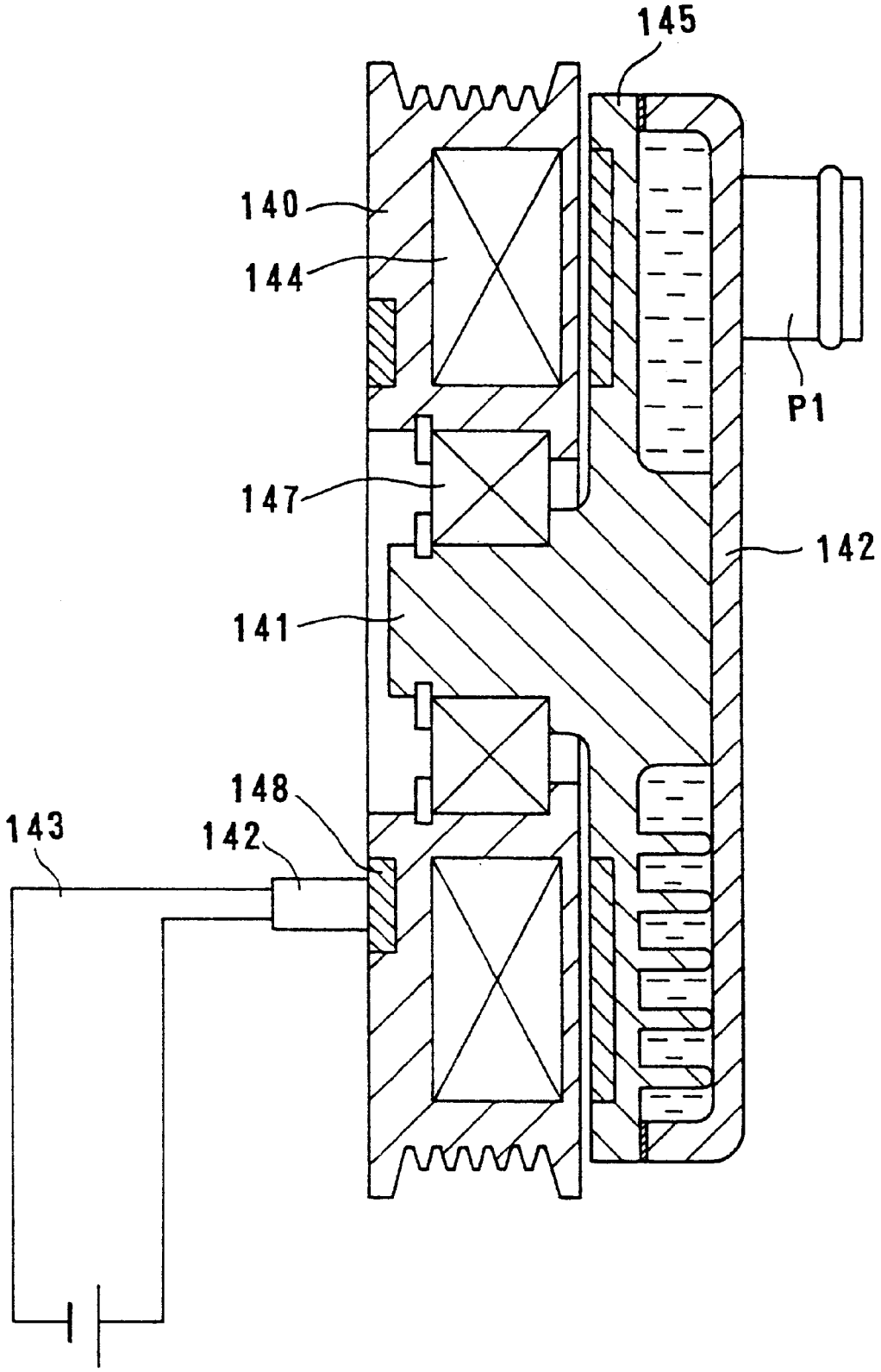
FIG. 13 is a longitudinal section view showing an embodiment of ON-OFF control means by means of an electromagnet of the magnetic heater of the same.
Figure 14:
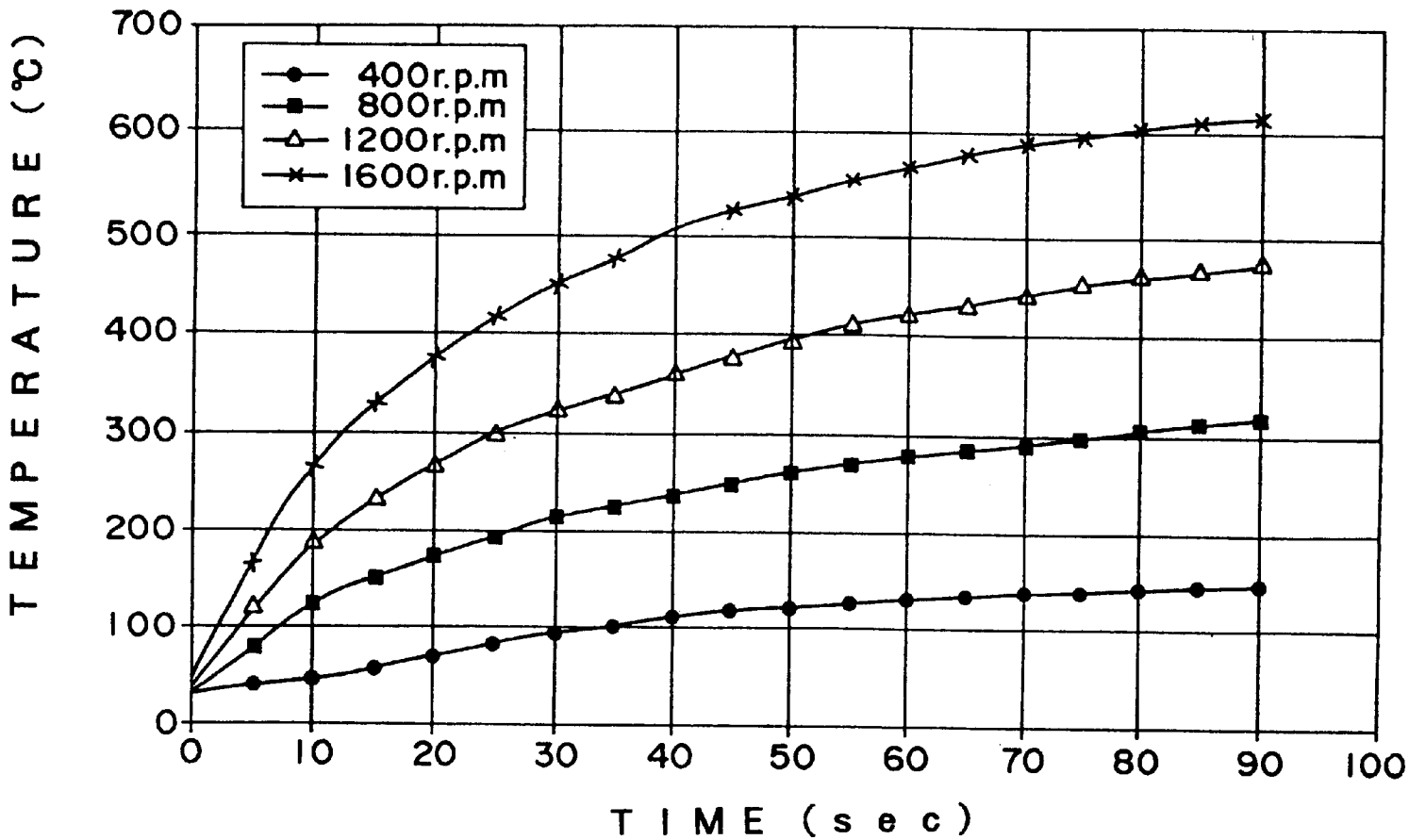
FIG. 14 is a graph showing one example of exothermic data of a test of a combination of a rare-earth permanent magnet and an eddy-current member which the inventor has conducted.

FIG. 1 is a longitudinal section view showing an embodiment of a magnetic heater corresponding to claim 2 of the invention, FIG. 2 is a longitudinal section view showing an embodiment of a magnetic heater corresponding to claim 3 of the same, FIG. 3 is a longitudinal section view showing an embodiment of a magnetic heater corresponding to claim 4 of the same, FIG. 4 is a longitudinal section view showing an embodiment of a magnetic heater corresponding to claim 5 of the same, FIG. 5 is a longitudinal section view showing an embodiment of a magnetic heater corresponding to claim 6 of the same, FIG. 6 is a longitudinal section view showing an embodiment of a magnetic heater corresponding to claim 7 of the same, FIG. 7 is a longitudinal section view showing an embodiment of a magnetic heater corresponding to claim 9 of the same, FIG. 8 is a longitudinal section view showing an embodiment of a magnetic heater corresponding to claim 10 of the same, FIG. 9 is a longitudinal section view showing an embodiment of a magnetic heater corresponding to claim 11 of the same, FIG. 10 is a longitudinal section view showing an embodiment of a magnetic heater corresponding to claim 13 of the same, FIG. 11 is a longitudinal section view showing an embodiment of ON-OFF control means by means of a motor of the magnetic heater of the same, FIG. 12 is a longitudinal section view showing an embodiment of ON-OFF control means by means of an electromagnetic clutch of the magnetic heater of the same, FIG. 13 is a longitudinal section view showing an embodiment of ON-OFF control means by means of an electromagnet of the magnetic heater of the same, and FIG. 14 is a graph showing one example of exothermic data of a test of a combination of a rare-earth permanent magnet and an eddy-current member which the inventor has conducted.

In the magnetic heater shown in FIG. 1, the whole rotary water jacket in a housing is made of a conductor. The heater is constructed such that permanent magnets 3 are fixed to the integral housing 2 supported by the outer periphery of a driving shaft 1 via a bearing 6 and a shaft sealer 7 so that one face thereof is exposed within the housing 2 and such that the disc-like rotary water jacket 4 secured to the driving shaft 1 is fixed within the housing 2 so that it faces to the permanent magnets 3 with a slight gap. The whole disc-like rotary water jacket 4 is made of the conductor created by pasting an eddy-current member on the magnetic surface of a hysteresis member, i.e., preferably a magnetic material such as an iron plate, cast iron and cast steel or created by the eddy-current member itself. A pulley 5 is attached to the driving shaft 1 so as to rotate by an engine of a vehicle through a belt. The integral housing 2 for storing the rotary water jacket 4 is provided with a water inlet port P1 and a water outlet port P2. A back plate 8 is a core member for concentrating magnetic fields generated by the permanent magnets 3 effectively to the rotary water jacket 4. Although it is not always necessary, it is preferable to be provided.

When the driving shaft 1 is driven by the engine via the pulley 5, the disc-like water jacket 4 which is made of the conductor as a whole rotates within the integral housing 2 in case of the magnetic heater shown in FIG. 1. Then, the magnetic path created between the permanent magnets 3 is sheared and the water jacket 4 causes slip heat. The heat is exchanged to circulating water, i.e., heat transferring fluid, within the integral housing 2.

In a magnetic heater shown in FIG. 2A, a permanent magnet 13 is stored in a housing 12 which is supported around a driving shaft 11 via a bearing 16 and a shaft sealer 17. The housing 12 is composed of a front housing 12-1 and a rear housing 12-2. The doughnut permanent magnet 13 is fixed to the front housing 12-1 via a yoke 13*a*. A rotary water jacket 14 fitted to the driving shaft 11 is provided within this housing and a conductor 15 which faces to the permanent magnet 13 leaving a slight gap therebetween is fixed to the water jacket so that the back thereof is exposed to the side of the rear housing 12-2. The conductor 15 is a hysteresis member or one composed by pasting an eddy-current member on the surface of the magnet side of a magnetic material such as iron plate, casted iron or casted steel and is the eddy-current material itself. A circular-arc fin 15*a* or a radial fin 15*b* is provided on the back thereof on the side of the rear housing 12-2 to enhance the efficiency of heat exchange. A through hole 14-1*a* of the circulating water, i.e., the heat transferring fluid, is perforated at the joint section of the water jacket 14. The housing 12 storing the permanent magnet 13 and the rotary water jacket 14 is provided with an water inlet port P1 and an water outlet port P2 which communicate to the inside of the housing. Meanwhile, a pulley 19 is fixed to the driving shaft 11 via a fastening bolt 17 and is rotated by the engine of the vehicle via a belt. It is needless to say that it is also possible to use a dedicated motor, wind and water power and the like as its driving source instead of the engine.

When the driving shaft 11 is driven by the engine via the pulley 19 in the hysteresis member constructed as described above, the water jacket 14 and the conductor 15 rotate within the housing 12. Then, a magnetic path formed between the permanent magnet 13 stored within the housing 12 is sheared and the conductor causes slip heat. The heat of the conductor 15 is heat-exchanged to the circulating water, the heat transferring fluid, within the housing 12 and the heated circulating water is utilized to warm the vehicle by the heating circuit.

Next, in a magnetic heater shown in FIG. 3A, a pair of right and left permanent magnets 23 disposed so as to face each other at a predetermined distance are stored in a housing 22 which is supported around a driving shaft 21 via a bearing 26 and a shaft sealer 27. The housing 22 is composed of a front housing 22-1 and a rear housing 22-2. The doughnut permanent magnets 23 are fixed via a yoke 23*a*. A rotary water jacket 24 fitted to the driving shaft 21 is provided between the permanent magnets 23 within this housing and a conductor 25 is fixed to the water jacket 24. Passages of the circulating water, the heat transferring fluid, are perforated through the water jacket 24. The passage is composed of a passage 24-1*a* perforated at the joint section of the water jacket 24 in the axial direction and a plurality of passages 24-1*b* provided in radial or preferably in the shape of a fan so as to pass through the right and left conductors while communicating with the passage 24-1*a*. It is noted that it is preferable to expose the back of the conductor 25 to the passage 24-1*a* because the heat exchange is promoted further. The housing 22 storing the permanent magnet 23 and the rotary water jacket 24 is provided with a water inlet port P1 and a water outlet port P2 which communicate to the inside of the housing. Meanwhile, a pulley 29 is fixed to the driving shaft 21 via a fastening bolt 28 and is rotated by the engine of the vehicle via a belt. It is needless to say that it is also possible to use a dedicated motor, wind and water power and the like as its driving source instead of the engine.

When the driving shaft 21 is driven by the engine via the pulley 29 in the hysteresis member constructed as described above, the water jacket 24 and the conductor 25 rotate within the housing 22. Then, a magnetic path formed between the pair of right and left permanent magnets 23 stored within the housing 22 is sheared and the conductor 25 causes slip heat. The heat of the conductor 25 is heat-exchanged to the circulating water, the heat transferring fluid, within the housing 22 and the heated circulating water is utilized to warm the vehicle by the heating circuit.

A magnetic heater shown in FIG. 4 is a cylinder type heater in which a permanent magnet rotor 33 fitted to a driving shaft 31 is stored within a cylinder type housing 32 supported around the driving shaft 31 via a bearing 37. A conductor 36 which faces to a ringed permanent magnet 34 fixed to the permanent magnet rotor 33 via a yoke 34*a* leaving a slight gap therebetween is fixed to the inner peripheral surface of the cylinder type housing 32. A water jacket 35 is fixed around the cylinder type housing 32 in which the conductor 36 is fixed by a fastening bolt 38. The water jacket 35 is provided with a water inlet port P1 and a water outlet port P2 not shown which adjoin each other and which communicate with the water jacket 35. It is noted that the driving shaft 31 is integrated with a pulley 39 so that it is rotated by an engine of the vehicle via a belt.

When the driving shaft 31 is driven by the engine via the pulley 39 in the magnetic heater shown in FIG. 4, the permanent magnet rotor 33 and the permanent magnet 34 rotate within the cylinder type housing 32 on the driving shaft 31 side. Then, a magnetic path formed between the conductor 36 fixed on the inner peripheral surface of the housing 32 and the permanent magnet 34 is sheared and the conductor 36 causes slip heat. The heat of the conductor 36 is heat-exchanged to the circulating water as the heat transferring fluid within the water jacket 35 and the heated circulating water is utilized to warm the vehicle by the heating circuit.

In a magnetic heater shown in FIG. 5, a water jacket (conductor) 42 made of an eddy-current member for example is non-rotably supported around a driving shaft 41 via a bearing 43 and magnet rotors 44-1 and 44-2 having doughnut-shaped permanent magnets 45-1 and 45-2 disposed on the both sides of the water jacket 42 so as to face to the jacket leaving a slight gap therebetween are fixed in a body with the driving shaft 41, respectively. Among them, one magnet rotor 44-1 is secured to the driving shaft 41 by a fastening bolt 47-1 and the other magnet rotor 44-2 is secured to the driving shaft 41 by a key (not shown) or the like. The doughnut-like permanent magnets 45-1 and 45-2 are fixed via yokes 45-1*a* and 45-2*a*, respectively. The water jacket is provided with a water inlet port P3 and a water outlet port P2. It is noted that a pulley 46 is fixed to the driving shaft 41 by the fastening bolt 47 so that it is rotated by an engine of the vehicle via a belt.

A magnetic heater shown in FIG. 6 is what a water jacket main body is made of resin in order to reduce the weight of the whole heater and to maintain the heat retaining property of the heat transferring fluid. The water jacket 52 constructed by fixing a conductor 52-2 made of an eddy-current member which is formed so as to correspond to a profile of the jacket main body to the front side of the water jacket main body 52-1 whose section has a shape of "]" in a body via seal rings 52-3 and 52-4 is supported non-rotably around a driving shaft 51 via a bearing 53 and a permanent magnet rotor having a doughnut-like permanent magnet 56 disposed so as to face to the conductor 52-2 of the water jacket 52 leaving a slight gap therebetween is fixed in a body with the driving shaft 51 by a fastening bolt 59. A back plate 54 is pasted to an inner wall of the conductor 52-2 on the side facing to the permanent magnet 56 within the water jacket 52. The water jacket 52 is provided with a water inlet port P1 and a water outlet port P2. It is noted that the driving shaft 51 is rotated by an engine of the vehicle via a pulley 57 and a belt in the same manner as described above. The reference numeral (58) denotes circulating water.

When the driving shaft 51 is driven by the engine via the pulley 57 in the magnetic heater constructed as described above, the permanent magnet rotor 55 integrated with the driving shaft 51 and the permanent magnet 56 rotate. Then, a magnetic path created between the conductor 52-2 made of the eddy-current member and fixed to the water jacket main body 52-1 made of resin is sheared and the conductor 52-2 causes slip heat. A strong magnetic field is created between the permanent magnet 56 by the action of the back plate 54 pasted on the inner wall of the conductor 52-2 on the side facing to the permanent magnet 56 and an enough eddy current is generated in the conductor 52-2 of the water jacket 52, thus enhancing the efficiency of the heater. The heat of the conductor 52-2 of the water jacket 52 is heat-exchanged to the circulating water 58, i.e., the heat transferring fluid, within the jacket 52 and the heated circulating water is utilized to warm the vehicle by a heating circuit in the same manner as described above. It is possible to obtain effects such that the volume of the water jacket may be increased, the heat may be recovered effectively, the radiation heat to the permanent magnet 56 may be reduced and a thermal influence to the seal rings 52-3 and 52-4 may be reduced because relative speed of the water jacket caused by the rotation is large at the outside of the back plate 54 of the conductor 52-2 in the peripheral direction, it is close to part where the heating value is large and it is fully cooled because the surface area (heat transferring area) is increased, in addition to the effects that the weight may be reduced as compared to the magnetic heater whose water jacket is made of the eddy-current member (made of pure copper, etc.) and the heat retaining property of the heat transferring fluid may be enhanced because thermal conductivity of resin is low in general by making the water jacket main body 52-1 by the resin in case of this magnetic heater. Still more, an effect of increasing the heating value may be obtained because leakage flux generated on the inner and outer peripheral sides of the permanent magnet may be taken into the side of the conductor 52-2 and the leakage flux may be reduced as a result by surrounding the permanent magnet 56 by forming the water jacket main body 52-1 into the shape of "[".

In a magnetic heater shown in FIG. 7, a doughnut-like permanent magnet 63 fixed to the inner wall of a housing 62 so as to be externally fitted to a driving shaft 61 and conductors 66 composed of a disc-like magnetic ring plate 65 and a doughnut-like retarder ring plate 64 secured to the driving shaft 61 on the both sides of the permanent magnet 63 so as to face thereto leaving a slight gap therebetween are stored within the housing 62 supported around the driving shaft 61 via a bearing 67 and a shaft sealer 68. The housing 62 of this heater is composed of a front housing 61*a* and a rear housing 61*b* and is provided with a water inlet port P1 on the side of the rear housing 61*b* and a water outlet port P2 on the side of the front housing 61*a*. The water inlet port P1 and the water outlet port P2 communicate to the inside of the housing 61.

When the driving shaft 61 is driven by an engine for example in the magnetic heater shown in FIG. 7, the conductors 66 composed of the disc-like magnetic ring plate 65 and the doughnut-like retarder ring plate 64 secured to the driving shaft within the housing 62 rotate. Then, a magnetic path created between the permanent magnet 63 stored within the housing 62 is sheared and the conductor 66 causes slip heat. The heat of the conductor 66 is heat-exchanged to circulating water, heat transferring fluid, within the housing 62.

A magnetic heater shown in FIG. 8 is a two-step type heater in which two permanent magnets are disposed and conductors 76 provided in a pair with the respective permanent magnets are rotated. In the heater, the two doughnut-like permanent magnets 73 fixed to the inner wall of a housing 72 so as to be externally fitted to a driving shaft 71 leaving a predetermined gap and conductors 76 composed of a disc-like magnetic ring plate 75 and a doughnut-like retarder ring plate 74 secured to the driving shaft 71 on the both sides of the permanent magnet 73 so as to face thereto leaving a slight gap therebetween are stored within the housing 72 supported around the driving shaft 71 via a bearing 77 and a shaft sealer 78. The housing 72 of this heater is composed of a front housing 71*a* and a rear housing 71*b* and is provided with a water inlet port P1 on the side of the rear housing 71*b* and a water outlet port P2 on the side of the front housing 71*a* also in this heater. It is noted that a space is provided between the right and left permanent magnets 73 and the conductors 76 so that the right and left magnetic circuits do not interfere each other.

When the driving shaft 71 is driven by an engine for example in the magnetic heater shown in FIG. 8, the conductors 76 rotate and magnetic paths created between the two permanent magnets 73 stored within the housing 72 are sheared. Then, the respective conductors 76 cause slip heat. The heat of the conductors 76 is heat-exchanged to circulating water, heat transferring fluid, within the housing 72 in the same manner as described above. Because the heat transferring fluid flows through the space created between the right and left permanent magnets 73 and the conductors 76, heat transfers well.

While the both heaters in FIGS. 7 and 8 are the type in which the magnet is fixed and the conductor rotates in the structure in which the conductors are disposed on the both sides of the permanent magnets so as to face thereto, FIG. 9 illustrates a magnetic heater of the type in which the magnets are rotated in the structure in which the conductors are disposed on the both sides of the permanent magnet so as to face thereto. In the heater, a doughnut-like permanent magnet 83 fixed around the driving shaft 81 via a magnet supporter 83*a* and conductors 86 composed of a disc-like magnetic ring plate 85 and a doughnut-like retarder ring plate 84 fixed to the inner wall of the housing so as to face thereto leaving a slight gap therebetween on the both sides of the permanent magnet 83 are stored within the housing 82 supported around the driving shaft 81 via a bearing 87 and a shaft sealer 88. The housing 82 is composed of a front housing 82*a* and a rear housing 82*b* and is provided with a water inlet port P1 at the center of the front housing 81*a* and a water outlet port P2 at the outer peripheral part. The water inlet port P1 and the water outlet port P2 communicate to the inside of the housing.

The magnetic ring plate 85 as the conductor 86 may be what the retarder ring plate 84 made of the eddy current member such as copper and aluminum is pasted on the magnet side surface of a magnetic material such a hysteresis material or preferably alnico, ferrite stainless, an iron plate, casted iron and casted steel or may be made from the eddy-current material or solely from a magnetic material. The driving shaft 81 is rotated by a belt via a pulley or the like by an engine of the vehicle, a dedicated motor or wind and water power.

When the driving shaft 81 is driven by the engine for example in the magnetic heater constructed as described above, the permanent magnet 83 fixed in a body with the driving shaft within the housing 82 and magnetic paths created between the conductors 86 stored within the housing 82 are sheared and the respective conductors 86 cause slip heat. The heat of the conductors 86 is heat-exchanged to circulating water, heat transferring fluid, within the housing 82 and the heated circulating water is utilized to warm the vehicle by the heating circuit.

A magnetic heater shown in FIG. 10 is what is arranged so that a driving shaft and a magnet can be rotated in the opposite directions via a planetary gear mechanism and so as to be obtain a maximum heating value by increasing a relative speed of a centrifugal fan and the permanent magnet by rotating a carrier of the planetary gear mechanism in the direction opposite from the driving shaft. In the magnetic heater, a wheel disc 93*a* of the centrifugal fan 93 fixed to the driving shaft 91 and stored in a fan casing 92 is made of a conductor and a cylindrical magnet rotor 94 having the permanent magnet 95 facing to the wheel disc 93*a* made of the conductor while leaving a slight gap is supported by the driving shaft 91 so as to be capable of rotating reversely via the planetary gear mechanism comprising a sun gear 96, a pinion gear 97, a carrier 98 and a ring gear 99. The sun gear 96 of the planetary gear mechanism is fixed to the driving shaft 91 and the pinion gear 97 engaging with the sun gear 96 is axially supported by the carrier 98 fixed to the driving shaft 91 via a bearing 100 and the ring gear 99 engaging with the pinion gear 97 is internally fitted to the magnet rotor 94 in a body therewith and is supported by a bearing 101 provided between the carrier 98, and a pulley 102 is fixed to the carrier 98 of the pinion gear 97 so that the carrier 98 can be rotated in the direction opposite from the driving shaft 91 via the pulley 102. A joint part of the fan casing 92 and the magnet rotor 94 is sealed point-applicably by a sealing section 103.

Accordingly, when the driving shaft 91 is driven in the magnetic heater, the heat transferring fluid flown into the fan casing 92 from a heat transferring fluid inlet port P1 flows as indicated by arrows and in the same time, the relative speed of the centrifugal fan 93 and the permanent magnet 95 increases and the maximum heating value may be obtained by rotating the carrier 98 in the opposite direction from the driving shaft 91 via the pulley 102 when the magnet rotor 94 supported to the driving shaft 91 via the planetary gear mechanism rotates in the opposite direction from the centrifugal fan 93.

Next, a concrete example of ON-OFF control means of the magnetic heater described above will be explained based on FIGS. 11 through 13.

FIG. 11 shows a case in which a driving motor is used as the ON-OFF control means of the magnetic heater. In the magnetic heater, the driving motor 112 is provided on the back thereof, a permanent magnet rotor 114 fitted to a driving shaft 111 of the driving motor 112 is stored within a front housing 113 and a water jacket 116 facing to the permanent magnet rotor 114 leaving a slight gap is fastened and stacked by a bolt not shown via a gasket G interposed between a rear housing 113-1 on the back of the jacket. A doughnut-like permanent magnet 115 is fixed to the permanent magnet rotor 114 via a yoke 115*a* and a conductor 117 facing to the permanent magnet 115 leaving a slight gap is fixed to the water jacket 116. The rear housing 113-1 fixed to the back of the water jacket 116 is provided with a water inlet port P1 and a water outlet port not shown which adjoin each other and which communicate to the e water jacket 116. The water jacket 116 is provided with fins 116*a* in order to enhance the efficiency of heat exchange. The fins may be formed into a spiral, radial or circular-arc shape.

When the driving motor 112 is activated in the magnetic heater constructed as described above, the permanent magnet rotor 114 fixed to the driving shaft 111 rotates around the axial core and the permanent magnet 115 rotates. Then, a magnetic path created between the conductor 117 fixed to the front face of the water jacket 116 and the permanent magnet 115 is sheared and the conductor 117 causes slip heat. The heat of the conductors 117 is heat-exchanged to circulating water, heat transferring fluid, within the water jacket 116 and the heated circulating water is utilized to warm the vehicle by the heating circuit.

In case of the magnetic heater shown in FIG. 11, a temperature sensor for example may be used to measure the temperature of the heat transferring fluid, to turn OFF the driving motor 112 when it reaches to a predetermined temperature or to gradually reduce a speed of the driving motor 112 from that point.

FIG. 12 shows a case in which an electromagnetic clutch is used as the ON-OFF control means of the magnetic heater. In the magnetic heater, a permanent magnet rotor 123 fitted to a driving shaft 121 is stored in a housing 122 supported around the driving shaft 121 via a bearing 129 and a water jacket 116 facing to the permanent magnet rotor 123 leaving a slight gap is fastened and stacked by a through bolt 127 via a gasket G interposed between a rear housing 122-1 on the back of the jacket. A doughnut-like permanent magnet 124 is fixed to the permanent magnet rotor 123 via a yoke 124*a* and a conductor 126 facing to the permanent magnet 124 leaving a slight gap is fixed to the water jacket 125. The conductor 126 is formed by pasting an eddy-current member on the surface of the permanent magnet 124 of a base member such as a hysteresis member and an iron plate . The rear housing 122-1 fixed to the back of the water jacket 125 is provided with a water inlet port P1 and a water outlet port not shown which adjoin each other and which communicate to the water jacket 125. The water jacket 125 is provided with fins 125*a* in order to enhance the efficiency of heat exchange.

The electromagnetic clutch for controlling ON-OFF 130 is coupled to the driving shaft 121 in the magnetic heater. The electromagnetic clutch 130 comprises a clutch rotor 132 rotably supported by the front housing 122 via a bearing 131, an exciting oil 133 provided in the housing 122 so as to be positioned within the clutch rotor 132, a hub 135 fastened to the driving shaft 121 by a fastening bolt 134 and an armature 136 held to be movable to the exciting coil 133 side by the hub. It is noted that the clutch rotor 132 is rotated by an engine of the vehicle not shown via a belt.

When the electromagnetic clutch 130 is turned ON and is activated in the magnetic heater constructed as described above, the permanent magnet rotor 123 fixed to the driving shaft 121 rotates around the axial core and the permanent magnet 124 rotates. Then, a magnetic path created between the conductor 126 fixed to the front face of the water jacket 125 and the permanent magnet 124 is sheared and the conductor 126 causes slip heat. The heat of the conductors 126 is heat-exchanged to circulating water, heat transferring fluid, within the water jacket 125 and the heated circulating water is utilized to warm the vehicle by the heating circuit.

FIG. 13 shows a case when an electromagnet is used as the ON-OFF control means of the magnetic heater, i.e., a type in which the electromagnet 144 is used as a magnet and is rotated so that a conductor on the stationary side generates slip heat. In this case, the electromagnet 144 is incorporated to a pulley 140, a slip ring 148 is fixed to the side of the pulley and power is fed to the electromagnet 144 via a feeding slider 142 from a feed cable 143. A water jacket 145 facing to the pulley 140 leaving a slight gap is fixed in a body with the driving shaft 141 supported to the pulley 140 via a bearing 147 and a conductor 146 is fixed to a face of the water jacket 145 facing to the pulley. It is noted that the housing 142 fixed to the back of the water jacket 145 is provided with a water inlet port P1 and a water outlet port not shown which communicate with the water jacket 145 and which adjoin each other.

Accordingly, the ON-OFF of the heater may controlled by the electromagnet 144 in case of this magnetic heater.

Clad members and coated ones may be used as the conductor used in the invention.

For example, a clad member of an eddy-current member and a magnetic material may be used because the clad member allows the eddy-current member and a core member to be integrated, a low cost, a compacted product and high productivity to be realzed and the reliability to be improved because the quality excels. Although a normal clad member has been a material of a two-layered structure in which another clad member is bonded with a material, i.e., a base material, a material in which a number of homo-materials or hetero-materials are laminated as a multi-layered clad has been developed recently. Then, not only the two-layered structure clad member but also the multi-structure clad member having the eddy-current member on the magnet side may be employed in the invention. The clad member in which films of two or more kinds of metals in order of micron are laminated has an excellent characteristic different from the conventional materials because a magnetic field from the permanent magnet transmits without being damped so much because the magnetic material is very thin and reaches to the eddy-current member and causes heat. Then, it causes a large heating value by repeating that by a number of times. Among them, a material in which iron or stainless steel is multi-layered with copper and aluminum for example has been confirmed to have properties of thermal conductivity and magnetic characteristics and is suitable as the conductor of the magnetic heater.

It is also possible to provide a heat insulating layer at least on the surface of the heat transferring fluid jacket facing to the permanent magnet by coating, molding or pasting it.

That is, in case of the magnetic heater of the type in which the heat is generated by fixing the conductor and by rotating the magnet, an air flow flowing radially is generated around the permanent magnet rotating at high speed. Because the heat transferring fluid jacket made of the conductor is cooled by the air because it is exposed to the radial air flow, the transfer of the heat to the heat transferring fluid within the heat transferring fluid jacket is hampered as a result. Then, in order to prevent the heat transferring fluid jacket from being cooled by the air as much as possible, the heat insulating layer is provided at least on the surface of the heat transferring fluid jacket facing to the permanent magnet by coating or the like to prevent the heat transferring fluid jacket from being cooled by the radial air flow. In this case, the heat insulating layer may be provided on the whole outer surface of the heat transferring fluid jacket. The heat insulating layer may be provided on the whole outer surface of the heat transferring fluid jacket by surrounding the heat transferring fluid jacket by the heat insulating layer. As the heat insulator, there may be cited resin, foaming resin, felt, cotton, ceramics, asbestos or their combination for example.

FIG. 14 illustrates exothermic data of a combination of a rare-earth permanent magnet and the eddy-current member which the inventor has tested. This data shows the relationship between temperature and time (sec.) measured by changing a revolving speed of the magnet side variously while fixing the eddy-current member side by disposing the permanent magnet and the eddy-current member so as to face each other while setting the gap therebetween to 1.0 mm.

This data shows that the conductor causes slip heat of 200 to 800° C. in several to several tens seconds by disposing the magnet and the conductor leaving a slight gap and by rotating the magnet and the conductor relatively. Accordingly, when the water jacket is attached to the conductor side, temperature on the surface thereof for heat-exchanging with the circulating water may be heated to the high temperature of 200 to 800° C. in a very short time.

It is needless to say that heat transferring oil, silicon oil, refrigerant or gas such as air may be adopted for example beside water as the heat transferring fluid in the invention. It is also applicable to evaporation of liquid (such as a boiler).

As described above, because the inventive magnetic heater is what a magnet such as a permanent magnet, an electromagnet and a thermal ferrite is combined with a conductor made of a magnetic material and a hysteresis member on which an eddy-current member is provided on the magnet side surface thereof or the eddy-current member and what utilizes slip heat caused in the conductor when the conductor side or the magnet side is rotated within the heat transferring fluid, it allows the structure to be simplified more, the miniaturization and the low cost to be realized and the high reliability and safety to be assured by the non-wear and non-contact mechanism. In addition to them, it brings about the excellent effects that it can warm engine cooling water quickly and can improve the engine warming function remarkably by driving the conductor side by the engine or the like when heating is required quickly when the engine is cold for example. Accordingly, the inventive magnetic heater exhibits the excellent effects as an auxiliary heater which is; capable of heating the heat transferring fluid to high temperature efficiently in a short time and is very effective for vehicles specific to a cold district and mounting a diesel engine in particular. The magnetic heater of the type in which conductors are disposed on the both sides of one permanent magnet to generate heat on the both sides allows a higher heat recovering efficiency to be obtained. It is also possible to heat separate heat transferring fluids in the same time by partitioning the housing into a plurality of chambers. The magnetic heater arranged so that the driving shaft side and the magnet rotor side can be rotated in the opposite direction by the planetary gear mechanism brings about excellent effects that a fully wide range of relative revolving speed of the driving shaft side and the magnet rotor side can be assured, a high exothermic efficiency can be obtained and the heating value may be readily controlled.

While the preferred embodiments have been described, variations thereto will occur to those skilled in the art within the scope of the present inventive concepts which are delineated by the following claims.

What is claimed is:

1. A magnetic heater of the type in which a magnet and a conductor are disposed so as to face to each other leaving a slight gap and heat transferring fluid is heated by slip heat which is generated in said conductor by relatively rotating said magnet and said conductor, wherein said magnetic heater comprising:

a permanent magnet fixed to a housing supported to a driving shaft via a bearing; and a flat disc-like conductor facing to said permanent magnet while leaving a slight, constant gap provided rotably to said driving shaft within said housing;

the heat transferring fluid introduced to the inside of said housing being in fluid communication with said disc-like conductor, said heat transferring fluid being heated by the slip heat generated in said conductor as said disc-like conductor rotates.

2. A magnetic heater as in claim 1, wherein said disc-like conductor is a rotary water jacket.

3. A magnetic heater as in claim 1, wherein said disc-like conductor comprises a magnetic material having an eddy-current member pasted on a surface of said magnetic material.

4. A magnetic heater as in claim 3, wherein said disc-like conductor further comprises a back plate being a core member for concentrating magnetic fields generated by said permanent magnet to said disc-like conductor.

* * * * *